United States Patent [19]

Rex

[11] 4,285,604

[45] Aug. 25, 1981

[54] RIBBON SHIELD FOR PRINTER

[75] Inventor: Donald K. Rex, Highland Beach, Fla.

[73] Assignee: International Business Machines Corporation, Armonk, N.Y.

[21] Appl. No.: 86,568

[22] Filed: Oct. 19, 1979

[51] Int. Cl.[3] ..... B41J 33/32

[52] U.S. Cl. ..... 400/247; 400/124

[58] Field of Search ..... 400/247, 248, 248.1, 400/123, 124

[56] References Cited

U.S. PATENT DOCUMENTS

| | | | |
|---|---|---|---|
| 383,480 | 5/1888 | Osborne | 400/247 |
| 2,409,237 | 10/1946 | Banks | 400/247 X |
| 2,788,111 | 4/1957 | Spiegel | 400/247 |
| 3,017,981 | 1/1962 | Keith | 400/247 |
| 3,047,121 | 7/1962 | Roggenstein | 400/247 |
| 3,941,231 | 3/1976 | Matuck et al. | 400/248 X |
| 4,165,188 | 8/1979 | Rempel | 400/248 |

FOREIGN PATENT DOCUMENTS

| | | | |
|---|---|---|---|
| 472065 | 9/1937 | United Kingdom | 400/247 |

OTHER PUBLICATIONS

"Angled Ribbon Guide", IBM Tech. Discl. Bulletin, vol. 19, No. 10, Mar. 1977, pp. 3817–3818.

"Typing Shield", IBM Tech. Discl. Bulletin, vol. 5, No. 11, Apr. 1963, pp. 30–31.

"Side of Forms, End of Forms, & Forms Jam-Detection Scheme for Printers", IBM Tech. Discl. Bulletin, vol. 20, No. 11A, Apr. 1978, pp. 4266–4269.

"Ribbon Shield with Integral Aligner & Turning Stanchions", IBM Tech. Discl. Bulletin, vol. 22, No. 8A, Jan. 1980, pp. 3071–3072.

"Print Head to Platen & Ribbon to Print Heads Separation", IBM Tech. Discl. Bulletin, vol. 20, No. 11A, Apr. 1978, pp. 4270–4271.

*Primary Examiner*—E. H. Eickholt

*Attorney, Agent, or Firm*—D. Kendall Cooper

[57] ABSTRACT

A user replaceable printer ribbon shield of simple design is provided for use in high speed matrix printers utilizing continuous forms. The shield is detachably mounted. During printing, the shield prevents outfolds in the forms from catching on the ribbon and prevents ribbon ink from migrating to the forms. It moves with the platen slightly away from the matrix print head when the machine is idle for at least a preset period of time. This causes the ribbon to move away from the ends of the print wires in the matrix print head to keep print wire lubricatng oil from migrating to the ribbon.

3 Claims, 8 Drawing Figures

RIBBON SHIELD FOR PRINTER

DESCRIPTION

1. Background of the Invention

This invention relates to ribbon shields, particularly those used in conjunction with high speed printers, such as those operated under control of a host computer. Traditional techniques for separating paper and ribbon include introducing very thin members between ribbon and paper as permanent parts of the machine. These are often made from thin sheet metal, plastic and sometimes small wires. Because these elements are thin they tend to be fragile and as a result are easily damaged. The damage often requires a service call.

2. Summary of the Invention

It is a purpose of the present invention to provide a ribbon shield, which, as an example, is supplied to customers with each ribbon cartridge of a wire matrix printer and which is discarded when the next cartridge is inserted. This shield can be manufactured from a high tensile strength film such as Mylar* (*Registered trademark, Dupont Corp.) or from sheet metal. Regardless of the material selected, the shield is preferably pulled taut between a set of anchor posts and is positioned between the printed form and the ribbon at the print line.

The printer ribbon shield per se is a user replaceable member from polyethylene or other material and serves the dual purposes of holding the ribbon away from the paper and holding the paper against the platen. The ribbon shield cooperates with the platen assembly in a wire matrix printer and moves with the platen away from the print heads when the printer is idle for at least a preset period of time. This allows the ribbon to separate from the ends of the print wires to keep print wire lubricating oil from migrating to the ribbon and to prevent ink from the ribbon from migrating to the print wires. For service or to insert forms, the platen can be pivotally moved completely away from the print wires but the ribbon shield does not follow the platen in this extreme movement.

CROSS-REFERENCE TO RELATED PATENT APPLICATIONS

The present patent application is one of a group of copending patent applications which concern the same overall printer subsystem configuration but which individually claim different inventive concepts embodied in such overall printer subsystem configuration. These related patent applications were filed on the same date, namely, Oct. 19, 1979. Two of these applications of particular interest are listed below and are specifically incorporated by reference herein:

(1) Application Ser. No. 086,484 entitled "Printer Subsystem with Microprocessor Control", the inventors being Messrs. William W. Boynton, et al; and (2) Application Ser. No. 086,483 entitled "Print Wire Actuator Block Assembly for Printers", the inventor being Mr. Albert W. Oaten.

For a better understanding of the present invention, together with other and further advantages and features thereof, reference is made to the description taken in connection with the accompanying drawings, the scope of the invention being pointed out in the appended claims.

BRIEF DESCRIPTION OF THE DRAWINGS

Referring to the drawings.

DESCRIPTION OF PRINTER SUBSYSTEM AND PRINTER MECHANISMS

In order to best illustrate the utility of the present invention, it is described in conjunction with a high speed matrix printer, typically capable of printing in a high range of lines per minute on continuous forms.

Figure 1:
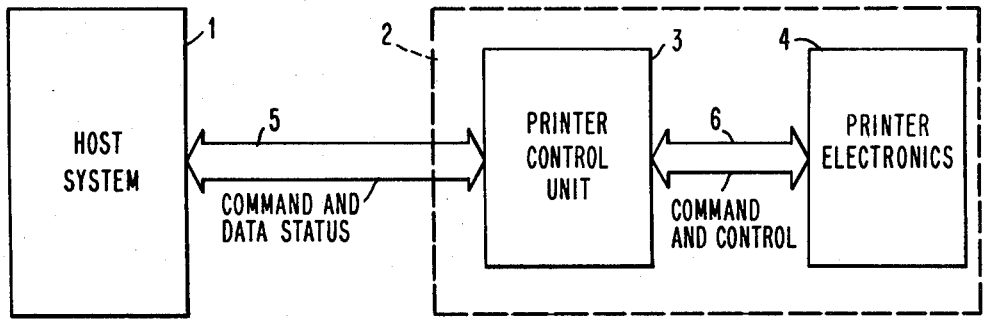
FIG. 1 is a simplified system diagram for the printer subsystem in which the ribbon shield is utilized.

FIG. 1 illustrates a representative system configuration including a host system 1 and the printer subsystem 2 which includes a printer control unit 3 and printer electronics 4. Command and data signals are provided from the host system by way of interface 5, and command and control signals are provided from printer control unit 3 to the printer electronics 4 by way of bus 6. Status signals are supplied by printer control unit 3 to host system 1 by way of interface 5. Typically, the host system 1 generates information including commands and data, and monitors status. Printer control unit 3 receives the commands and data, decodes the commands, checks for errors and generates status information, controls printing and spacing, and conducts printer diagnostics. Printer electronics 4 executes decoded control unit commands, monitors all printer operations, activates print wires, drives motors, senses printer emitters, and controls operator panel lights and switching circuitry. It controls the tractor/platen mechanism, the ribbon drive, the print head (i.e., actuator group) carrier, the operator panel, and the printer sensors.

The elements of the system, such as the printer control unit and printer electronics, incorporate one or more microprocessors or microcomputers to analyze commands and data and to control operations.

Figure 2:
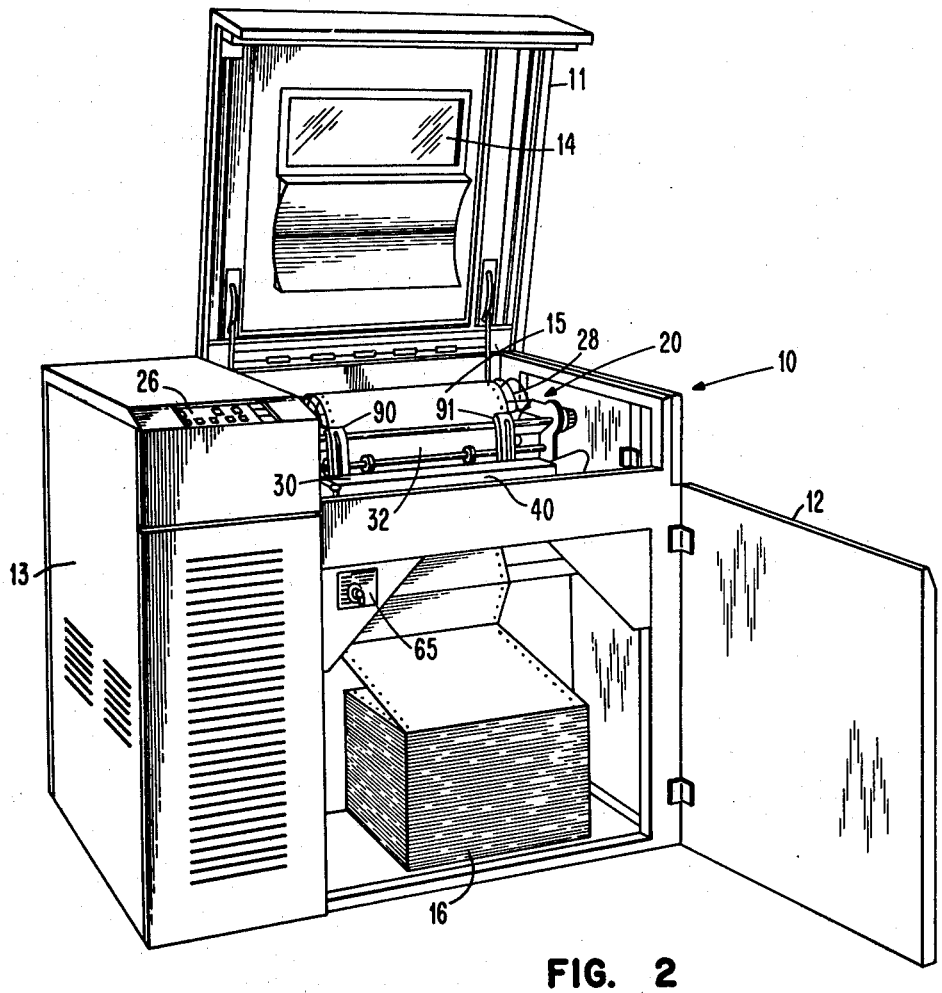
FIG. 2 illustrates the printer console and a number of printer components as well as forms feeding.
Figure 3:
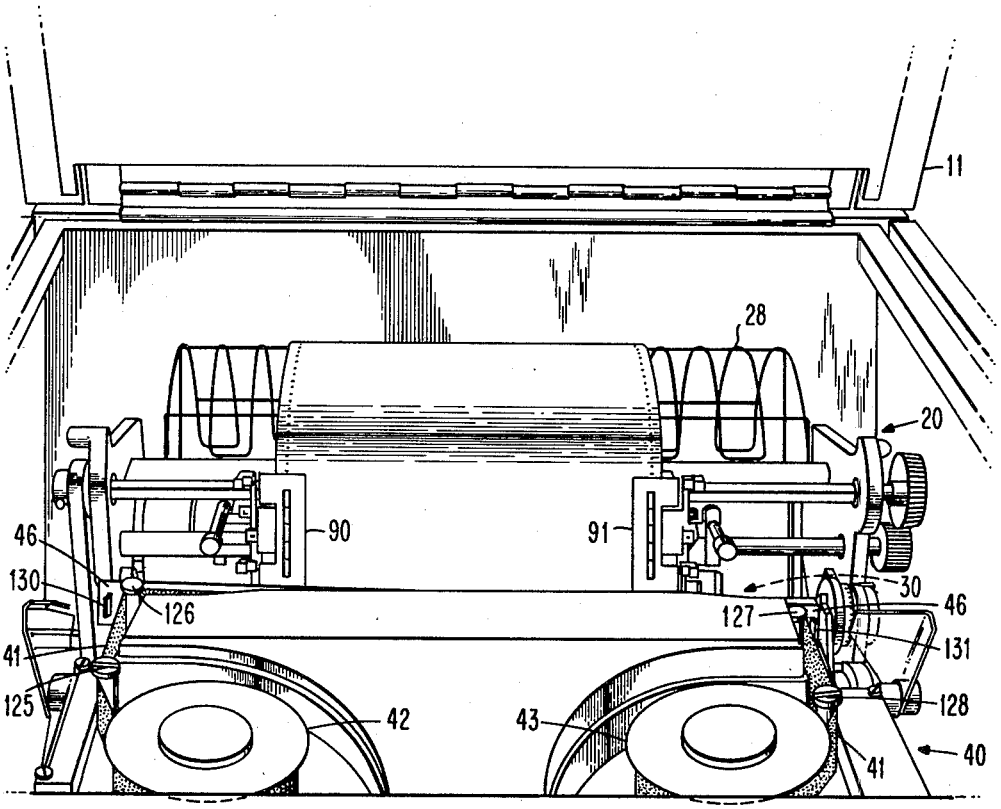
FIG. 3 is a frontal view of the printer unit.

FIGS. 2 and 3 illustrate various components of the printer all of which are housed in console 10. Various access panels or covers such as those designated 11, 12, and 13 are provided. Top cover 11 has a window 14 that enables an operator to observe forms movement during operation of the printer and when the top cover is closed. Forms (documents) 15 are provided from a stack 16 and can be fed in one embodiment upwardly or downwardly as viewed in FIGS. 2 and 3 by means of a forms feed assembly 20 which includes one or more sets of forms tractors such as the upper set comprising tractors 90 and 91. A forms guide 28 guides the forms after printing to a takeup stack, not shown, but positioned below the printing mechanism and to the rear of the printer console. The printer incorporates a print assembly 30 that is positioned generally in a horizontal relationship with respect to forms 15 at a print station 32. Print assembly 30 is more clearly visible in other views.

This is also true of the printer ribbon drive assembly 40 which is located in closer proximity to the front of the printer. Printer control unit 3 and its associated microprocessors are generally located behind the side cover 13.

A ribbon 41 is provided on one of the spools 42 or 43, which are disposable. Each box of ribbons would preferably contain a disposable ribbon shield 46 that fits between print assembly 30 and forms 15 to keep ribbon 41 in proper alignment and to minimize ink smudging on forms 15. Two motors, not shown herein, but shown and described in the Boynton et al application, drive ribbon 41 back and forth between spools 42 and 43. The printer control unit detects ribbon jams and end-of-ribbon (EOR) conditions. A ribbon jam turns on an error indicator and stops printing. An EOR condition reverses the ribbon drive direction.

The printer includes an operator panel 26 (shown and described in greater detail in the Boynton et al application) that consists of several operator control keys, two indicator lights, a power on/off switch, and an operator panel display.

A 16-position mode switch 65 (shown and described in the Boynton et al application) has an on-line position that permits printing to be controlled by the using system. All other positions are off-line and do not allow printing to be initiated from the using system.

RIBBON SHIELD

Figures 4, 5, 6:
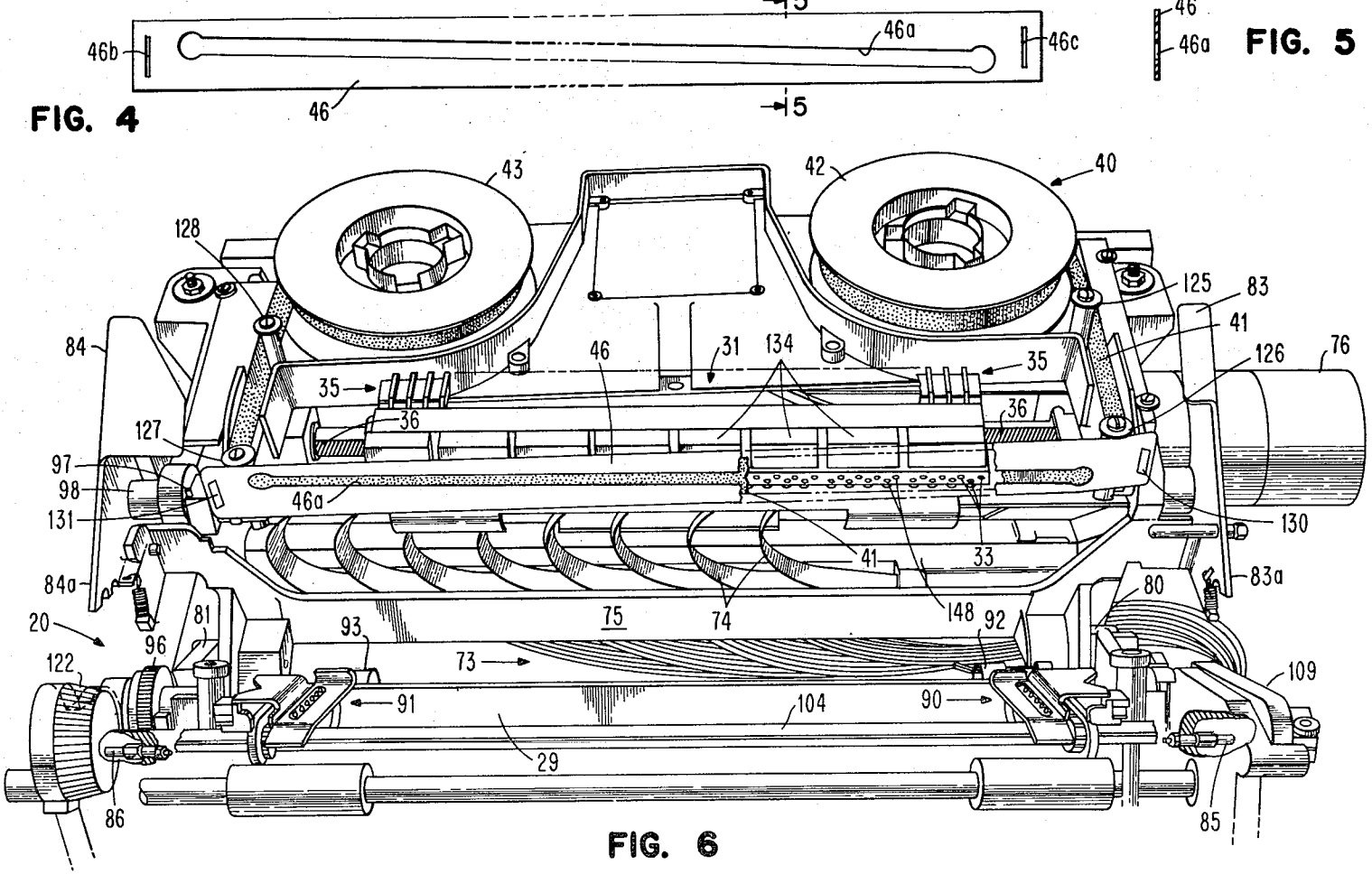
FIG. 4 is a view of the ribbon shield having a slit positioned in a horizontal plane.
FIG. 5 is a cross-section of the ribbon shield on the lines 5—5 in FIG. 3.
FIG. 6 is an overhead view of the printer slightly from the rear of the unit showing the forms feed open.

FIG. 4 illustrates the ribbon shield 46 that is particularly useful in the printer of FIG. 3. FIG. 5 is a cross-sectional view along the lines 5—5 in FIG. 4. Shield 46 has an elongated aperture **46*a* extending almost its entire length. The aperture enables the print wires 33 to press against the ribbon in the printer through the shield in order to print on forms 15. Shield 46 has slits 46*b* and 46*c* at opposite extremities to permit easy mounting in the printer on spring members 130 and 131 of the ribbon drive assembly, FIGS. 3 and 6. Shield 46 and ribbon 41 are illustrated slightly on the bias in FIGS. 3 and 6 which is their more normal relationship in the printer. The ribbon drive assembly 40 is also positioned on a slight bias relative to horizontal to establish the bias of shield 46 and ribbon 41. In this condition aperture 46*a* assumes a horizontal relationship with respect to the print wires 33 and forms 15**.

OVERVIEW OF PRINTER MECHANISMS

FIGS. 3 and 6 in particular show some details of construction of the forms feed assembly 20, print assembly 30, and ribbon drive assembly 40.

Forms feed assembly 20 has end plates (side castings) which support the various forms feed mechanisms including a drive motor to drive tractors 90 and 91 through timing belt 109, and a platen 29 located behind the forms and against which the print wires 33 are actuated during printing. See also FIGS. 7 and 8.

The print assembly includes a base casting 75 supporting various mechanisms including print motor 76 and connected to drive a print head carrier 31 in a reciprocal fashion horizontally to effect printing on the forms.

The ribbon drive assembly 40 includes a support casting 44, a cover 45, and drive motors, not shown.

FORMS FEED ASSEMBLY

In order to load paper in the printer the forms feed assembly 20 pivots away from the base casting 75 at pivot points 80 and 81, to allow access to thread the paper into position. Latches 83 and 84 are raised by the operator so that extremities **83*a* and 84*a* disengage eccentric pins 85 and 86 on the forms feed assembly. The forms feed assembly then pivots away from the operator as viewed in FIGS. 2 and 3. This allows access to the tractors so that the operator may load paper. The forms feed assembly is then reclosed and relatched by latches 83 and 84** for normal machine operation. During the time that the forms feed assembly is pivoted back for service, a switch prevents machine operation. This switch is actuated by a tang on the forms feed assembly when it is closed.

Referring to FIG. 6, the forms feed assembly includes means for adjusting for forms thickness. As mentioned, the entire forms feed assembly pivots back from the rest of the printer about pivot points 80 and 81. In the closed position the forms feed assembly is in such a position that a spiral cam 8 and knob assembly 96 engages a pin 97 on the main carrier shaft 98 of the print assembly 30. Adjustment of the spiral cam and knob assembly 96 is such that it rotates the main carrier shaft 98. As described in the Boynton et al application, rotation of shaft 98 moves latches 83 and 84 which changes the distance between assemblies 20 and 30 and thus the distance between the ends of print wires 33 and platen 29. This adjustment enables the printer to accommodate forms of various thicknesses. The printer can handle forms from one part to six parts thickness.

The paper feeding is accomplished by four sets of tractors 90–93 two above the print line and two below the print line. The individual tractors include drive chains to which pins are attached at the proper distance to engage the holes in the forms. Forms may be moved through the tractor forms feed mechanism manually by rotating knob 122. This knob simply engages the top drive shaft 104 of the upper tractor set and through the timing belt 109 provides rotational action to the lower tractor set, as well.

PRINT ASSEMBLY

In FIG. 6 print assembly 30 comprising, a carrier 31, an actuator block assembly and support described in the Oaten application accommodates all the print heads with their wire actuators 35 and print wires 33. This assembly is structured to hold from 2 up to 8 or 9 print head groups of eight actuators each. Thus, a printer with eight print head groups, as shown in FIG. 6, has sixty-four print wire actuators and sixty-four associated print wires 33. Print wires 33 project through apertures 148, FIG. 6. To insure long life of the print wires, lubricating assemblies 134 containing oil wicks are positioned in proximity to the print wires. The print wire actuators fire the wires to print dots to form characters. Carrier 31 is shuttled back and forth by a lead screw 36 driven by motor 76. Lead screw 36 drives the carrier back and forth through nuts which are attached to the carrier. When carrier 31 is located at the extreme left as viewed in FIG. 3 (to the right as viewed in FIG. 6) this is called the "home position". When the carrier is moved to the home position, a cam attached to the carrier engages a pin, the pin being attached to the main carrier shaft 98. If the machine has not been printing for some period of time in the neighborhood of a few seconds, the printer control unit signals the carrier to move all the way to the left, in which case the cam engages the pin to rotate the main carrier shaft 98 approximately 15 degrees. As shaft 98 rotates, eccentrics associated with latches 83 and 84 separate tractor assembly 20 from print assembly 30.

The current necessary to fire the print actuators is carried to the actuators via the cable assemblies 73, FIG. 6, one for each group of eight actuators.

RIBBON DRIVE ASSEMBLY

The ribbon drive assembly 40 for the printer is shown in FIGS. 3 and 6 primarily. Spools 42 and 43 which contain the ribbon can be seen on either side of the machine near the front, FIG. 3 and are respectively driven by stepper motors 49 and 50. These spools typically contain 150 yards of nylon ribbon that is one and a half inches wide. In one direction of feed the ribbon path is from the left-hand spool 42 past posts 125 and 126, FIGS. 3 and 6, across the front of the ribbon drive assembly between the print heads 34 and forms 15, then past posts 127 and 128 back to the right-hand ribbon spool 43. The ribbon shield is generally located between posts 126 and 127 and is mounted on the two attachment spring members 130 and 131.

Figure 7:
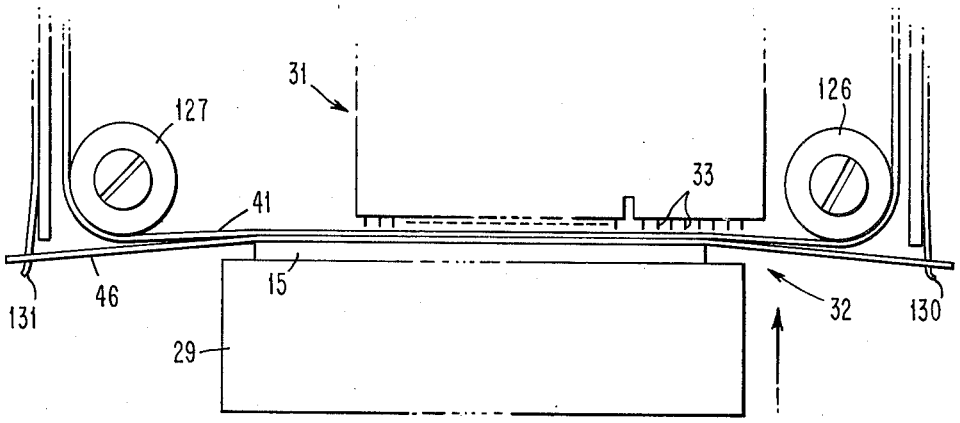
FIG. 7 illustrates the condition of various elements at the print station when the printer is in a print mode.

FIG. 7 illustrates the relationship of various elements at the print line 32 during printing, only portions of these elements being shown. These elements are shown in a highly diagrammatic form. Sizes and relationships are somewhat exaggerated to illustrate the relationships at the print line. In the condition shown in FIG. 7, platen 29 positions forms 15 adjacent shield 46 and ribbon 41 and in proximity to wires 33 to effect printing of dots on the form by appropriate activation of actuators in carrier assembly 31. A slight tension exists on ribbon 41 and shield 46.

Figure 8:
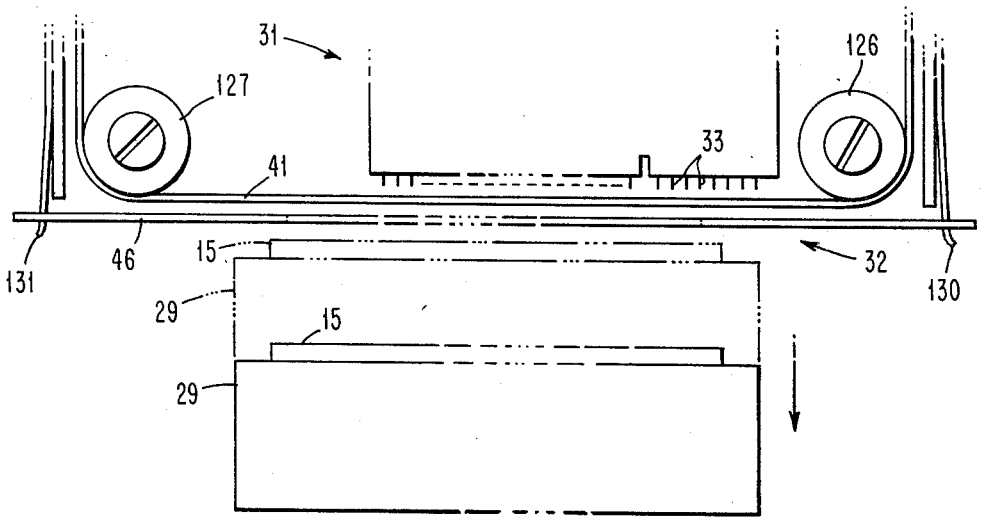
FIG. 8 illustrates the condition of various elements at the print station when the printer is in a non-print mode.

When carrier assembly 31 moves to home position, shaft 98 is rotated and through latches 83 and 84 (FIG. 6) moves platen 29 and forms 15 away from the other elements to the dotted line condition as represented in FIG. 8. In this condition, all elements are fully separated and thus contamination of the various elements by the ink in the ribbon or migration of ink or print wire lubricating oil is prevented.

The solid line representation of forms 15 and platen 29 in FIG. 8 illustrate the much wider gap created when forms assembly 20 is moved completely away from the print line such as during loading of forms.

In any printer that uses a ribbon, there is always the problem of keeping the ribbon and paper away from one another. The ribbon can cause smudging on the paper and occasionally the paper can drag the ribbon out of the printing region causing a malfunction. Wire matrix printers pose a special problem because the very short wire stroke reduces the gap between the print head and paper which the printer ribbon may occupy.

The ribbon shield 46 has additional functions. Its main purpose is to keep the ribbon in its proper position during that time when printing is occurring and, more importantly, when paper is being transported vertically past the ribbon. There is always a tendency for what is called an "outfold" of the paper to grab the ribbon and move it in the same direction that the paper is moving. The ribbon shield is essentially designed to prevent that, namely, to keep the outfold from grabbing hold of the ribbon and pulling it along so that it is not in position to print the following lines. Essentially, the shield performs a number of functions: (1) protects the ribbon from the outfold pulling it along and (2) keeps the ribbon in its proper suspended location between print wire actuators and paper during those times when printing does not occur.

Shield 46 supplants the conventional guides with a shield that is ordinarily packaged with the ribbon and is installed by the customer at least each time that the ribbon is changed. Among the advantages of this are the following:

1. The shield does a better job of keeping paper away from the ribbon;

2. If there should be an accident that damages the shield, a new ribbon and shield (or perhaps just a shield) may be installed by the customer, obviating the need for a service call.

3. The design of the shield protects the customer from getting ink on his hands during the ribbon changing process.

While a preferred embodiment of the invention has been illustrated and described, it is to be understood that there is no intention to limit the invention to the precise constructions herein disclosed and the right is reserved to all changes and modifications coming within the scope of the invention as defined in the appended claims.

I claim:

1. A ribbon shield arrangement for a printer unit having a print station with a print line, said print station incorporating a forms feed assembly with a platen supporting forms to be printed upon, a print assembly at said print station for printing upon said forms as they move past said print line, said print assembly incorporating a plurality of print heads, each of which comprises a plurality of print wires and a plurality of actuators and said print heads being mounted in an elongated array along said print line for printing information on said forms, said print wires and actuators being arranged along said print line in a nonconventional print wire pattern, such as a slanted serrated pattern, said print assembly incorporating means to reciprocate said print heads along said print line and to concurrently operate said print wire actuators in order to print on said forms, and a ribbon drive assembly arranged to drive a ribbon along said print line during printing operations, said shield arrangement comprising:

a one-piece detachable ribbon shield member, said ribbon shield member comprising a flexible elongated plastic or metallic element having at least one aperture substantially corresponding in size and dimensions to the largest area occupied by said print wires along said print line as said print heads are reciprocated along said print line and said ribbon shield member including a pair of slits therein located a predetermined distance apart in said ribbon shield member, one of said slits being located near each extremity of said ribbon shield member; and ribbon shield mounting means comprising a pair of complementary flat spring elements at each end of said print line, said elements extending toward said print line, said spring elements being respectively engageable with the pair of slits in said ribbon shield member to position said ribbon shield member along said print line, said ribbon shield mounting means being arranged to retain said ribbon shield between said forms and between said ribbon during printing operations to protect said forms and said ribbon but to allow printing through the elongated aperture in said ribbon shield member by said print assembly during printing operations.

2. The ribbon shield arrangement of claim 1, wherein said print line is positioned along a predetermined direction of orientation in said printer unit and wherein said ribbon feeds along said print line at a selected angle with respect to said predetermined direction of orientation whereby a greater portion of the surface of said ribbon passes by said print line to more efficiently utilize said ribbon and wherein said ribbon shield member is oriented when mounted in the same angle of orientation as said ribbon but wherein the elongated aperture in said ribbon shield member is in the same direction of orientation and direction of movement as said print head assembly.

3. The ribbon shield arrangement of claim 1 wherein said predetermined direction of orientation of said print line is substantially horizontal and wherein the aperture in said ribbon shield member is positioned horizontally along said print line when said ribbon shield and ribbon are mounted at said selected angle.

* * * * *